United States Patent [19]

Nishikawa

[11] Patent Number: 4,878,986

[45] Date of Patent: Nov. 7, 1989

[54] WEB BUTT SPLICING DEVICE

[75] Inventor: Tetsuo Nishikawa, Haibara, Japan

[73] Assignee: Fuji Photo Film Co., Ltd., Kanagawa, Japan

[21] Appl. No.: 284,286

[22] Filed: Dec. 14, 1988

[30] Foreign Application Priority Data

Dec. 17, 1987 [JP] Japan ..... 62-319786

[51] Int. Cl.[4] ..... B65H 19/14; B65H 19/18

[52] U.S. Cl. ..... 156/504; 156/159; 156/304.3; 156/505; 242/58.4; 242/58.5

[58] Field of Search ..... 156/159, 304.3, 504, 156/505, 506; 242/58.1, 58.4, 58.5, 56 R

[56] References Cited

U.S. PATENT DOCUMENTS 4,188,257 2/1980 Kirkpatrick ..... 156/504
4,414,048 11/1983 Kontz ..... 156/159
4,564,413 1/1986 Murakami ..... 156/504
4,629,531 12/1986 Kataoka ..... 156/504
4,705,226 11/1987 Goetz ..... 156/504

*Primary Examiner*—Michael Wityshyn
*Attorney, Agent, or Firm*—Sughrue, Mion, Zinn, Macpeak & Seas

[57] ABSTRACT

A web butt splicing device for splicing two successive webs by butting the following end of a first roll of web and the leading end of a second roll of web against each other. In the web splicing device, the following end of the first roll of web is cut and is then drawn to and held on the hold surface of a butt splicing table. The leading end of the second web roll is cut on a provisionally positioning table to the shape of the following end of the first web roll, is then carried to the butt splicing table by a carrying device and is butt spliced to the following end of the first web roll. Therefore, according to the web splicing device, the webs can be butt spliced together without recourse to a manual operation.

8 Claims, 2 Drawing Sheets

WEB BUTT SPLICING DEVICE

BACKGROUND OF THE INVENTION

1. Field of the Invention

The present invention relates to a device for butt splicing webs such as plastic films, paper, metal foil or the like and, in particular, to such web butt splicing device in which the following end of a first roll of web is butt spliced to the leading end of a second roll of web and thereby the webs can be supplied successively to a following treatment line.

2. Description of the Related Art

Conventionally, an operation to butt splice the following end of a first roll of web, which has been rewound completely, to the leading end of a second roll of web to be rewound has been performed manually by an operator. In other words, when the rewinding of the first roll of web gets near completion, then the following end portion of the first roll of web is cut on a butt splicing table arranged in a carrier line. Next, the leading end of the second roll of web is moved and guided to the butt splicing table by the operator, is positioned on the butt splicing table, and is then butt spliced to the following end of the first roll of web. After then, the operator splices the butt spliced ends by use of a splicing tape.

Besides the manual web butt splicing method mentioned above, a web butt splicing device set forth in Japanese Patent Publication No. 48-38461 discloses a cutting method in which a web cutting drum is combined with a web cutting/splicing drum. Also, web butt splicing device set forth in Japanese Patent Application laid-open (Kokai) No. 59-24526 discloses a device for automatically guiding the leading end of a second roll of web to the splice position thereof thereof by means of a holding device.

However, in the above-mentioned web butt splicing method using the manual operation by the operator, there are found drawbacks as follows. At first, in the web splicing operation, other portions of the web than the web portion existing on the butt splicing table are treated in a continuous way by operating an accumulator such as a reservoir or the like without stopping a treatment line, but, if the splicing operation by the operator drags on, then the amount of accumulation may exceed its limit, which causes the line to stop. Secondly, the manual splicing operation places the operator under restraint and thus, if the splicing operation is carried out very frequently, then the operating efficiency thereof is lowered. Another problem is that such web butt splicing operation is not always safe.

Also, in the web butt splicing device in Japanese Patent Publication No. 48-38461, due to the fact that the carrying speed of the second roll of web is different from the carrying speed of the first roll of web, the positioning of the webs cannot be executed accurately. Further, in the web butt splicing device in Japanese Patent Application laid-open (Kokai) No. 59-24526, if the webs to be treated are too flexible, then it is impossible to position the leading end of the second roll of web on the web butt splicing table with accuracy.

SUMMARY OF THE INVENTION

The present invention aims at eliminating the drawbacks found in the above-mentioned prior art web butt splicing devices.

Accordingly, it is an object of the invention to provide a web butt splicing device which is capable of automatically positioning the ends of webs to be spliced with accuracy.

In order to attain the above object, according to the invention, there is provided a web butt splicing device which butts the following end of a first roll of web against the leading end of a second roll of web and then splices the butted ends by use of an adhesive tape, the butt splicing device comprising: a guide device for unwinding the leading end of the second roll of web from a roll and guiding the same web leading end; a provisionally positioning table including a hold surface to attract, position and hold the second roll of web thereon for provisionally positioning the leading end of the second roll web guided by the guide device on the hold surface; a butt splicing table including a cutting device and a hold surface for cutting the following end of the first roll of web into a given shape and positioning the cut web and on the hold surface to attract and position the webs thereon for attracting the leading end of the second roll of web from the hold surface, and, a carrier device including a hold surface of the provisionally positioning table by means of the hold surface thereof and for carrying the second web end to the butt splicing table to splice the same to the following end of the first roll of web.

In the web butt splicing device according to the invention, the leading end of the second roll of web is guided to the provisionally positioning table before it is butted against the following end of the first roll of web and after then the second web leading end is positioned on the provisionally positioning table. While it remains positioned accurately in this manner, the second web leading end is carried by the carrier device up to the butt splicing table where the first web following end is already cut. Thanks to this, the ends of the two webs can be automatically positioned with respect to each other in an accurate manner.

BRIEF DESCRIPTION OF THE DRAWINGS

The exact nature of this invention, as well as other objects and advantages thereof, will be readily apparent from consideration of the following specification relating to the accompanying drawings, in which like reference characters designate the same or similar parts throughout the figures thereof and wherein.

DETAILED DESCRIPTION OF THE DRAWINGS

Detailed description will hereunder be given of the preferred embodiments of a device for butt splicing webs together according to the present invention with reference to the accompanying drawings.

Figure 1D:
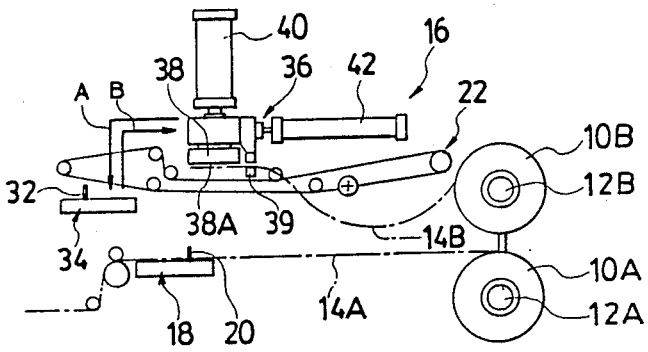
FIGS. 1 (A) through (E) are respectively explanatory views of a web butt splicing device according to the invention; and, FIG. 2 is an explanatory view of a modification of the web butt splicing device according to the invention.

Referring now to FIGS. 1(A) through (E), there are shown explanatory views, respectively illustrating a web butt splicing device according to the present invention. As shown in FIG. 1(A), a first roll 10A and a second roll 10B are respectively mounted onto a pair of mandrels 12A, 12B and, when the winding and feeding of a web 14A on the first roll 10A to a treatment line is completed and also the butt splice thereof is completed, the mandrels 12A and 12B are rotated 180° to thereby move the second roll 10B to the position of the first roll 10A.

On the left side of the first and second rolls 10A and 10B shown in FIG. 1(A), there is arranged a web butt splicing device 16 according to the present invention. The web butt splicing device 16 includes a butt splicing table 18, a guide device 22 a provisionally positioning table 34 and a web carrying device 36. The butt splicing table 18 is disposed on the line of the web 14A on the first roll 10A being currently carried or treated. The butt splicing table 18 is constructed in the form of a suction box and has an upper surface formed with a plurality of suction holes. This upper surface provides a hold surface 18A to which the web can be sucked for positioning. Also, there is arranged a web cutter 20 on the upper surface of the web butt splicing table 18, which web cutter 20 is used to cut the following end portion of the web 14A of the first roll 10A to a given shape.

Above the butt splicing table 18, there is arranged the guide device 22 of the web butt splicing device 16. The guide device 22 includes a plurality of rollers 24, 24, . . . , an endless carrier chain 26 to be wound around the rollers 24, 24, . . . , a carrier clamp 28 to be mounted to the carrier chain 26, a drive motor 29 for driving the carrier chain 26 to go between and around the rollers 24, and a torque limiter 30 for detecting the torque that is produced in the carrier chain 26. The leading end of a web 14B of the second roll 10B is mounted to the clamp 28, so that the leading end of the web 14B can be guided or moved up to the provisionally positioning table 34 by the clamp 28. The provisionally positioning table 34 is constructed in the form of a suction box and has an upper surface 34A which is formed with a plurality of air suction holes thereby providing a hold surface for the web to be sucked thereto and positioned thereon. Also, the upper surface 34A is provided with a web cutter 32 so that the leading end of the web 14B on the second roll 10B can be cut to a given shape.

Figure 1E:
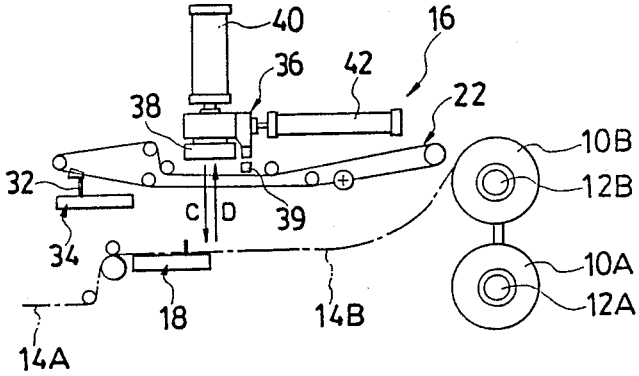
Figure 1:
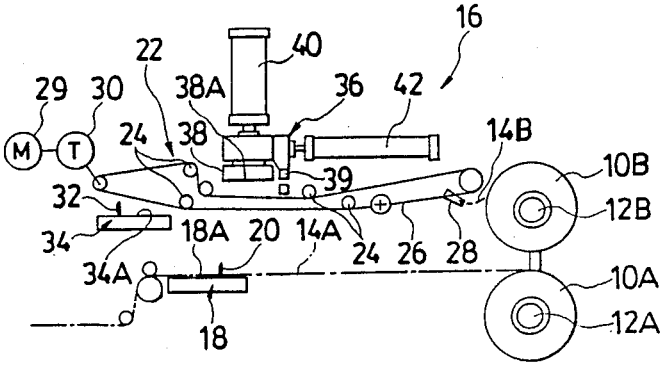
Figure 1:
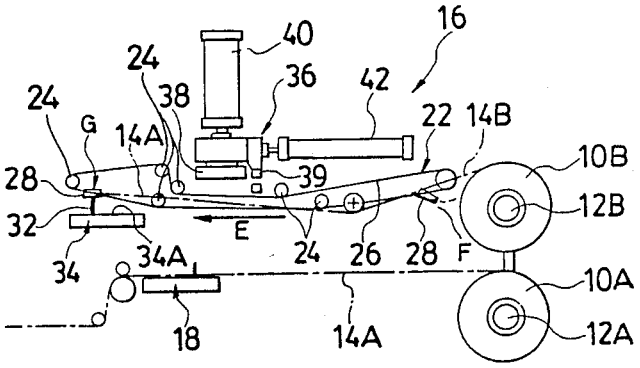
Figure 1:
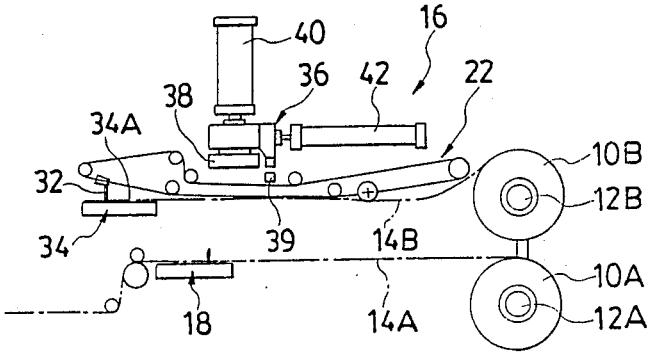

Further above the guide device 22, there is arranged a web carrying device 36 which comprises a suction box 38, a hold device 39 movable in the width direction of the web by a hydraulic cylinder (not shown), a vertically movable cylinder 40 for moving the suction box 38 and hold device 39 in the direction of an arrow A, and a horizontally movable cylinder 42 for moving the suction box 38 and hold device 39 in the direction of an arrow B, as shown in FIG. 1 (D). The suction box 38 of the carrying device 36 has a lower surface which provides a web suction surface 38A and the area of the suction surface 38A can be altered. Also, the suction surface 38A can be used to draw or such the leading end of the web 14B on the second roll 10B positioned on the provisionally positioning table 34 thereto and also to position and hold the web 14B leading end on the suction box 38.

According to the web butt splicing device of the invention constructed in the above-mentioned manner, when the feed-out of the web 14A of the first roll 10A draws to its close, the guide device 22 is put into operation. The leading end of the web 14B of the second roll 10B is mounted to the carrier clamp 28 of the guide device 22 and, as shown in Fig. 1(B), the leading end of the web 14B is moved from the position of F in the direction of an arrow E and is guided to the position of G. In this case, the moving speed of the clamp 28 is set to be slightly greater the feed-out speed of the web 14B by the mandrel 12B, so that a constant tension can be applied to the web 14B. In other words, if the clamp 28 is moved with the constant tension being applied to the web 14B, then the loads that cause the carrier chain 26 to move are applied onto a motor 29, thereby putting the torque limiter 30 into operation and causing the clamp 28 to stop. And, while the clamp 28 remains stopped, the web 14B is fed out from the second roll 10B sufficiently. Then, when the tension of the web 14B is lowered, then the torque limiter 30 is caused to return to its original state and thus the clamp 28 is moved again. Therefore, if a constant torque is given, then the motor 29 is caused to stop once and the clamp 28 is moved intermittently so that the web 14B of the second roll 10B can be guided up to the provisionally positioning table 34 with a tension being produced thereon.

As shown in FIG. 1(C), in the provisionally positioning table 34, the upper surface 34A thereof sucks the leading end of the web 14B accurately and holds it at a given position. Then, the thus positioned and held leading end of the web 14B of the second roll 10B is cut by the web cutter 32 to the shape of the following end of the web 14A of the first roll 10A.

Next, as shown in FIG. 1(D), the suction box 38 of the carrying device 36 is moved in the direction of the arrow A by the vertically and horizontally movable cylinders 40 and 42 and is positioned above the provisionally positioning table 34. Then, the suction surface 38A of the suction box 38 is pressed against the leading end portion of the web 14B of the second roll 10B that has been positioned and held on the provisionally positioning table 34. While the web 14A is being positioned, it is sucked from the provisionally positioning table 34 to the suction surface 38A of the suction box 38. And, the hold device 39 is moved in the width direction of the web 14B and holds the web 14B accurately.

From this state, the suction box 38 is moved in the direction of the arrow B shown in FIG. 1(D) by the vertically and horizontally movable cylinders 40 and 42, and while being positioned, the leading end of the web 14B of the second roll 10B waits above the butt splicing table 18.

With the web 14B of the second roll 10B being positioned and held in such a state as shown in FIG. 1(D), simultaneously with the end of the feed-out of the first roll 10A the mandrel 12A is caused to stop and thus the web feed-out is also stopped. In a following treatment line (not shown) in which the feed-out of the web 14A is stopped, an accumlater such as a reservoir and the like is operated, so that the treatment line can be operated continuously. However, the carriage of the web 14A is stopped. In the butt splicing table 18, the following end portion of the web 14A is sucked to the upper surface 18A of the butt splicing table 18 and is positioned and held there. And, the following end of the web 14A is cut by the web cutter 20 to a given shape.

Next, the leading end of the web 14B waiting in the suction box 38 of the carrying device 36 is lowered together with the suction box 38 in the direction of an arrow C shown in FIG. 1(E) down to the butt splicing table 16. By means of this, while being positioned, the following end of the web 14A of the first roll 10A and the leading end of the web 14B of the second roll 10B are butted against each other with accuracy. After then, only the suction box 38 is moved upward and the splice portions of the two webs are spliced together by means of an adhesive tape or the like. Then, the treatment line can be started accurately and promptly.

In this case, the following end of the first roll 10A and the leading end of the second roll 10B can be automatically positioned with accuracy by the web butt splicing device without recourse to the hands of the operator and, therefore, the splice of the web ends can be achieved in a short time.

Figure 2:
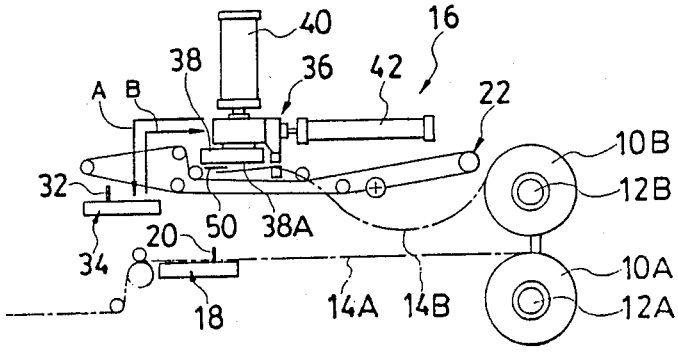

In the above-mentioned embodiment, the following end of the web 14A of the first roll 10A and the leading end of the web 14B of the second roll 10B are spliced to each other on the butt splicing table 18 and after then the splicing tape is adhered to the ends by the operator. However, alternatively, as shown in FIG. 2, with the splicing tape 50 being previously sucked and fixed to the suction box 38, simultaneously when the leading end of the web 14B of the second roll 10B is butted against the following end of the web 14A of the first roll 10A on the splicing table 18, the ends may be spliced together by use of the splicing tape 50.

As has been described hereinbefore, in the web butt splicing device according to the present invention, due to the fact there are arranged the web butt splicing table, provisionally positioning device and web carrying device in the web butt splicing device and the following end of the first roll of web and the leading end of the second roll of web are positioned by the respective devices before they are butted against each other, the ends of the first and second rolls of webs can be automatically positioned with accuracy for butt splice thereof.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A web butt splicing device for splicing a first roll of web to a second roll of web by butting the following end of the first roll of web against the leading end of the second roll of web using an adhesive tape, said device comprising:

a butt splicing table including a hold surface for attracting and positioning said first roll of web and a cutting device for cutting said following end of said first roll of web into a given shape;

a guide device for unwinding said leading end of said second roll of web from said second web roll and guiding the same;

a provisionally positioning table including a hold surface for attracting and holding a web, said table being adapted to hold on said hold surface said leading end of said second roll of web guided by said guide device; and, a web carrying device including a hold surface for attracting, positioning and holding a web, said device being adapted to attract and remove said leading end of said second roll of web from said hold surface of said provisionally positioning table by means of said hold surface thereof and carry said leading end of said second roll of web to said butt splicing table so as to butt said leading end of said second roll of web against said following end of said first roll of web.

2. A web butt splicing device as set forth in claim 1, wherein said butt splicing table is constructed as a suction box and said suction box has an upper surface which is formed with air suction holes to thereby provide said hold surface for a web.

3. A web butt splicing device as set forth in claim 2, wherein said guide device comprises an endless chain, a clamp mounted to said chain for holding said leading end of said second roll of web, and a motor for rotationally driving said chain.

4. A web butt splicing device as set forth in claim 3, wherein said guide device includes a torque limiter which is used to detect the rotational torque of said chain for driving, stopping and controlling of said motor.

5. A web butt splicing device as set forth in claim 4, wherein said provisionally positioning table is constructed as a suction box and said suction box has an upper surface which is formed with air suction holes to thereby provide said hold surface for a web.

6. A web butt splicing device as set forth in claim 5, wherein said web hold surface of said web carrying device can be moved from said provisionally positioning table to said butt splicing table by an air cylinder.

7. A web butt splicing device as set forth in claim 6, wherein said web carrying device has a suction box and said suction box has a lower surface which is formed with air suction holes to thereby provide said hold surface for a web.

8. A web butt splicing device as set forth in claim 7, wherein there is provided a splicing tape on said lower surface of said suction box and wherein, after said following end of said first roll of web is brought into butt contact with said leading end of said second roll of web on said butt splicing table, these two web ends are spliced together by means of said tape.

* * * * *